United States Patent [19]

Theurer et al.

[11] Patent Number: 5,052,306

[45] Date of Patent: Oct. 1, 1991

[54] MOBILE TRACK POSITION CORRECTING AND TAMPING MACHINE

[75] Inventors: Josef Theurer, Vienna; Friedrich Peitl, Linz, both of Austria

[73] Assignee: Franz Plasser Bahnbaumaschinen-Industriegesellschaft m.b.h., Vienna, Austria

[21] Appl. No.: 483,068

[22] Filed: Feb. 21, 1990

[30] Foreign Application Priority Data

May 3, 1989 [AT] Austria ..... 1062/89

[51] Int. Cl.[5] ..... E01B 27/17

[52] U.S. Cl. ..... 104/7.2; 104/12

[58] Field of Search ..... 104/2, 7.1, 7.2, 7.3, 104/10, 12

[56] References Cited

U.S. PATENT DOCUMENTS

| | | | |
|---|---|---|---|
| 3,799,058 | 3/1974 | Plasser et al. | 104/7.1 |
| 3,832,952 | 9/1974 | Hurni | 104/7.1 |
| 4,323,013 | 4/1982 | Theurer | 104/7.1 |
| 4,563,953 | 1/1986 | Theurer | 104/12 |
| 4,644,868 | 2/1987 | Theurer et al. | 104/12 |
| 4,646,645 | 3/1987 | Theurer | 104/12 |
| 4,893,565 | 1/1990 | Theurer | 104/7.2 |

FOREIGN PATENT DOCUMENTS

| | | | |
|---|---|---|---|
| 2035423 | 6/1980 | United Kingdom | 104/7.2 |
| 2147644 | 5/1985 | United Kingdom | 104/7.2 |

*Primary Examiner*—Robert J. Oberleitner
*Assistant Examiner*—Mark T. Le
*Attorney, Agent, or Firm*—Collard, Roe & Galgano

[57] ABSTRACT

A mobile track leveling, lining and tamping machine comprising a ballast tamping assembly mounted on an elongated machine frame and a track lifting and lining unit for correcting the position of the track, the unit being mounted on the machine frame adjacent the ballast tamping assembly and preceding the ballast tamping assembly in the operating direction, and the track lifting and lining unit comprising a two-part tool carrier frame extending in the direction of elongation of the machine frame, a first tool carrier frame part being arranged adjacent the ballast tamping assembly and rearwardly of a second tool carrier frame part in the operating direction, two pairs of flanged wheels supporting the tool carrier frame on the track rails, the two pairs of flanged wheels being rotatable about respective horizontal axes defining a plane and being spaced from each other to form a front pair and a rear pair of flanged wheels on the first tool carrier frame part in the direction of elongation of the machine frame and serving as track lining tools, at least two track lifting tools arranged on the first tool carrier frame part for adjustable engagement with each rail, and a pivot linking the tool carrier frame parts for pivoting about an axis extending perpendicularly to the plane defined by the axes of the flanged wheels. Lifting and lining drives have respective ends linked to the first tool carrier frame part and to the machine frame, and an end of the second tool carrier frame part remote from the pivot is linked to the machine frame.

16 Claims, 2 Drawing Sheets

Fig. 1
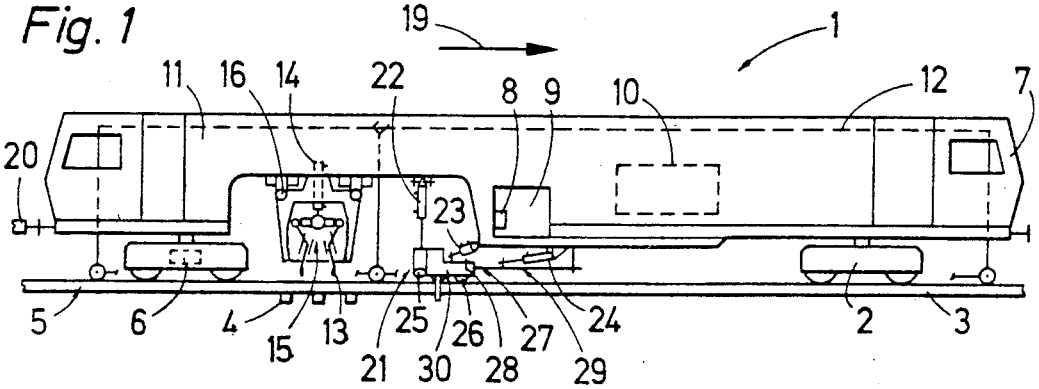
Fig. 2
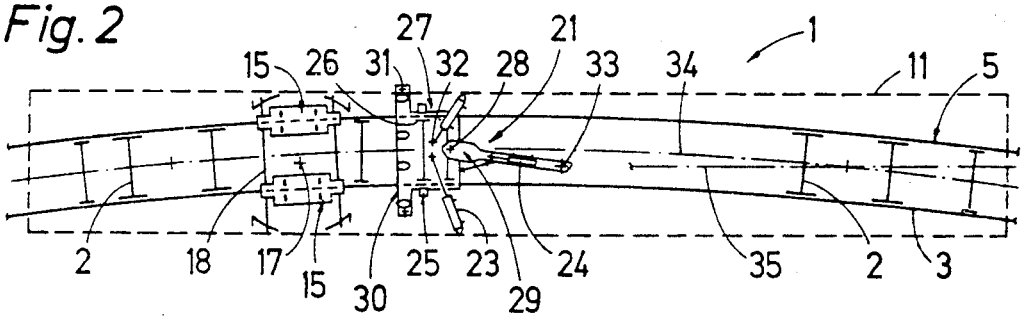
Fig. 7
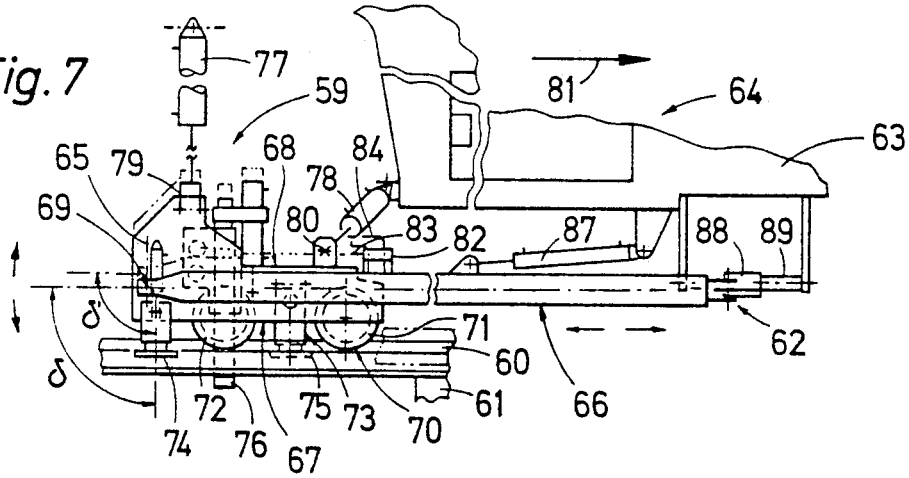
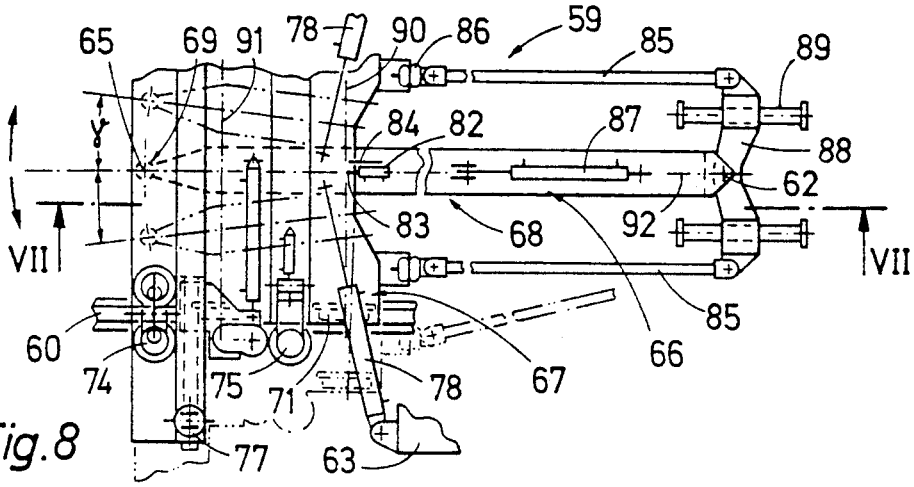
Fig.8

MOBILE TRACK POSITION CORRECTING AND TAMPING MACHINE

BACKGROUND OF THE INVENTION (1) Field of the Invention

The present invention relates to a mobile machine for correcting the position of a track and for tamping the track, which comprises an elongated machine frame mounted on the track for moving in an operating direction and a ballast tamping assembly mounted on the machine frame and including tamping tools arranged to tamp ballast under respective track ties. A track lifting and lining unit for correcting the position of the track is mounted on the machine frame adjacent the ballast tamping assembly and preceding the ballast tamping assembly in the operating direction, and the track lifting and lining unit comprises a tool carrier frame extending in the direction of elongation of the machine frame, two pairs of flanged wheels supporting the tool carrier frame on the track rails, and at least two track lifting tools arranged on the tool carrier frame for adjustable engagement with each rail. Lifting and lining drives have respective ends linked to the tool carrier frame and to the machine frame.

(2) Description of the Prior Art

U.S. Pat. No. 4,323,013, dated Apr. 6, 1982, discloses a compact track leveling, lining and tamping machine comprising an elongated machine frame supported on the track by two widely spaced undercarriages, a ballast tamping assembly and a track lifting and lining unit mounted on the machine frame between the undercarriages, which comprises a rigid tool carrier frame whose rear part adjacent the ballast tamping unit is linked to the machine frame by lifting and lining drives which are operatively controlled by a track leveling and lining system, and whose front part is a pole projecting forwardly from the rear part and is linked to the machine frame. A pair of flanged wheels supports the tool carrier frame on the track rails and the flanged wheels serve as track lining tools transmitting the lining forces to the rails. The track lifting tools are mounted on each longitudinally extending side of the tool carrier frame and comprise, per rail, two pairs of tong-like lifting rollers spaced from each other in the direction of elongation of the machine frame and a lifting hook arranged therebetween, with respective drives for vertically and laterally adjusting the lifting hook. The lifting rollers are transversely pivotal by independently operable drives for tong-like engagement with the respective rail. Such a track lifting and lining unit is capable of sustaining considerable lifting and lining forces, which makes it very useful for operation in track switches, which are very heavy. In such operations, the lifting hooks are of great advantage since they may be vertically adjusted for gripping either the rail foot or head, depending on whether they are used in a crib area or at a tie. Alternatively or in addition, depending on the configuration of the track section, the lifting rollers may be selectively engaged with the associated rail. The arrangement may also be used in tangent track sections, preferably by engaging both pairs of flanged lifting rollers with the track rails for so-called two-point lifting. At the points of abutment of two rail ends, one of the pairs of flanged wheels may be readily pivoted out of engagement with the rails at these points where the pair of flanged wheels remaining in engagement with the rails serves for a brief period of time to lift the track.

U.S. Pat. No. 3,799,058, dated Mar. 26, 1974, also discloses a mobile track leveling, lining and tamping machine with a two-point track lifting arrangement, the track lining tools comprising two pairs of flanged wheels supporting the tool carrier frame of a track lifting and lining unit on the track rails. The two pairs of flanged wheels are spaced from each other in the direction of elongation of the machine frame and are arranged between two pairs of tong-like track lifting rollers. The lifting and lining tools for each rail are mounted on a respective tool carrier frame whose front end is vertically adjustably linked to the machine frame in a vertical guide column and is connected to a hydraulic lifting and lining drive. This two-point lifting and lining enables tangent track to be repositioned efficiently since the lifting and lining forces can be advantageously distributed to two spaced rail points without subjecting the rail fastening elements to undue stress, such track leveling or lining also preventing undue bending or flexing of the rails.

U.S. Pat. No. 3,832,952, dated Sept. 3, 1974, describes a mobile track leveling, lining and tamping machine wherein the track lifting and lining tools are mounted on a transversely extending support beam linked to the machine frame by lifting and lining drives arranged in a vertical plane and by longitudinal adjustment drives arranged in a horizontal plane and linking the ends of the support beam to the machine frame. A flanged roller of very small diameter supports the support beam on each rail and serves as lining tool. A respective vertically and transversely adjustable lifting hook is mounted on the support beam opposite each flanged lining roller but staggered from its axis in the direction of elongation of the machine frame. To enable the lifting hook to engage the associate rail at a fish plate or a like obstacle, the support beam may be pivoted about a central vertical axis by a respective longitudinal adjustment drive, which disadvantageously affects the transmission of the lining forces in a direction extending obliquely to the track. The relatively light construction of the track lifting and lining unit incorporating small lining rollers and a single lifting tool per rail makes it impossible to use such a machine effectively in heavy switches or other complex track sections.

SUMMARY OF THE INVENTION

It is the primary object of this invention to improve a mobile machine of the first-described structure in a manner which assures better distribution of the track lining forces to two lining tools per rail.

In a mobile machine for correcting the position of a track and for tamping the track, the track including two rails fastened to ties defining cribs therebetween, the machine comprising an elongated machine frame mounted on the track for moving in an operating direction, a ballast tamping assembly mounted on the machine frame and including tamping tools arranged to tamp ballast under respective ones of the ties, and a track lifting and lining unit for correcting the position of the track, the unit being mounted on the machine frame adjacent the ballast tamping assembly and preceding the ballast tamping assembly in the operating direction, the above and other objects are accomplished according to the invention with a track lifting and lining unit comprising a two-part tool carrier frame extending in the direction of elongation of the machine frame, a first tool carrier frame part being arranged adjacent the ballast tamping assembly and rearwardly of a second tool carrier frame part in the operating direction, two pairs of flanged wheels supporting the tool carrier frame on the track rails, the two pairs of flanged wheels being rotatable about respective horizontal axes defining a plane and being spaced from each other to form a front pair and a rear pair of flanged wheels on the first tool carrier frame part in the direction of elongation of the machine frame and serving as track lining tools, at least two track lifting tools arranged on the first tool carrier frame part for adjustable engagement with each rail, and a pivot linking the first and second tool carrier frame parts for pivoting about an axis extending substantially perpendicularly to the plane defined by the axes of the flanged wheels. Lifting and lining drives have respective ends linked to the first tool carrier frame part and to the machine frame, and an end of the second tool carrier frame part remote from the pivot is linked to the machine frame.

This relatively simple structural modification advantageously assures a more even distribution of the lining forces from the spaced flanged lining wheels to a respective one of the track rails in track sections of different track gauges, particularly in track curves and greater gauge tolerances, which enhances the accuracy of the lining operation. The resultant improved and absolutely exact two-point engagement of the rail being lined distributes only half the lining force to each engaged rail point even in difficult track sections, including such tracks whose concrete ties are so heavy that the track displays a very strong resistance to lateral movement, so that the stress on the rail fastening elements is considerably relieved. Since the lifting and lining tools are arranged on the rear tool carrier frame part and the lifting and lining drives are linked thereto, the lining force will automatically pivot the rear tool carrier frame about the axis extending substantially perpendicularly to the plane defined by the axes of the flanged lining wheels, particularly in track curves, until both wheels extend substantially parallel to the associated rail, i.e. each flanged wheel presses under a uniform pressure against the rail. This automatic adjustment of the flanged lining wheels to the rails by the pivoting of the tool carrier frame parts in relation to each other proceeds until the lining forces applied to the rear tool carrier frame part pivot the same substantially independently of the front tool carrier frame part until the pivoting movement is stopped when the flanges of the two wheels are flush with the rail head. In addition, this arrangement of the two tool carrier frame parts still permits the tool carrier frame to be built with a forwardly projecting center pole or beam, which is a very advantageous construction of the tool carrier frame. It can be used for leveling and lining even the heaviest track switches but is universally usable in tangent track and in switches.

BRIEF DESCRIPTION OF THE DRAWING

The above and other objects, advantages and features of the present invention will become more apparent from the following detailed description of certain now preferred embodiments, taken in conjunction with the accompanying, partially schematic drawing wherein FIG. 1 is a side elevational view of a mobile track leveling, lining and tamping machine incorporating a track lifting and lining unit with a two-part tool carrier frame in accordance with this invention;

FIG. 2 is a top view of the machine of FIG. 1, seen in a track curve, wherein the outlines of the machine are shown in broken lines and the two tool carrier frame parts are pivoted in relation to each other;

FIG. 7 is a fragmentary side elevational view of another embodiment of the track lifting and lining unit, seen in the direction of arrow VII in FIG. 8; and FIG. 8 is a top view of the track lifting and lining unit of FIG. 7.

DETAILED DESCRIPTION OF THE PREFERRED EMBODIMENTS

Figures 3, 4, 5, 6:
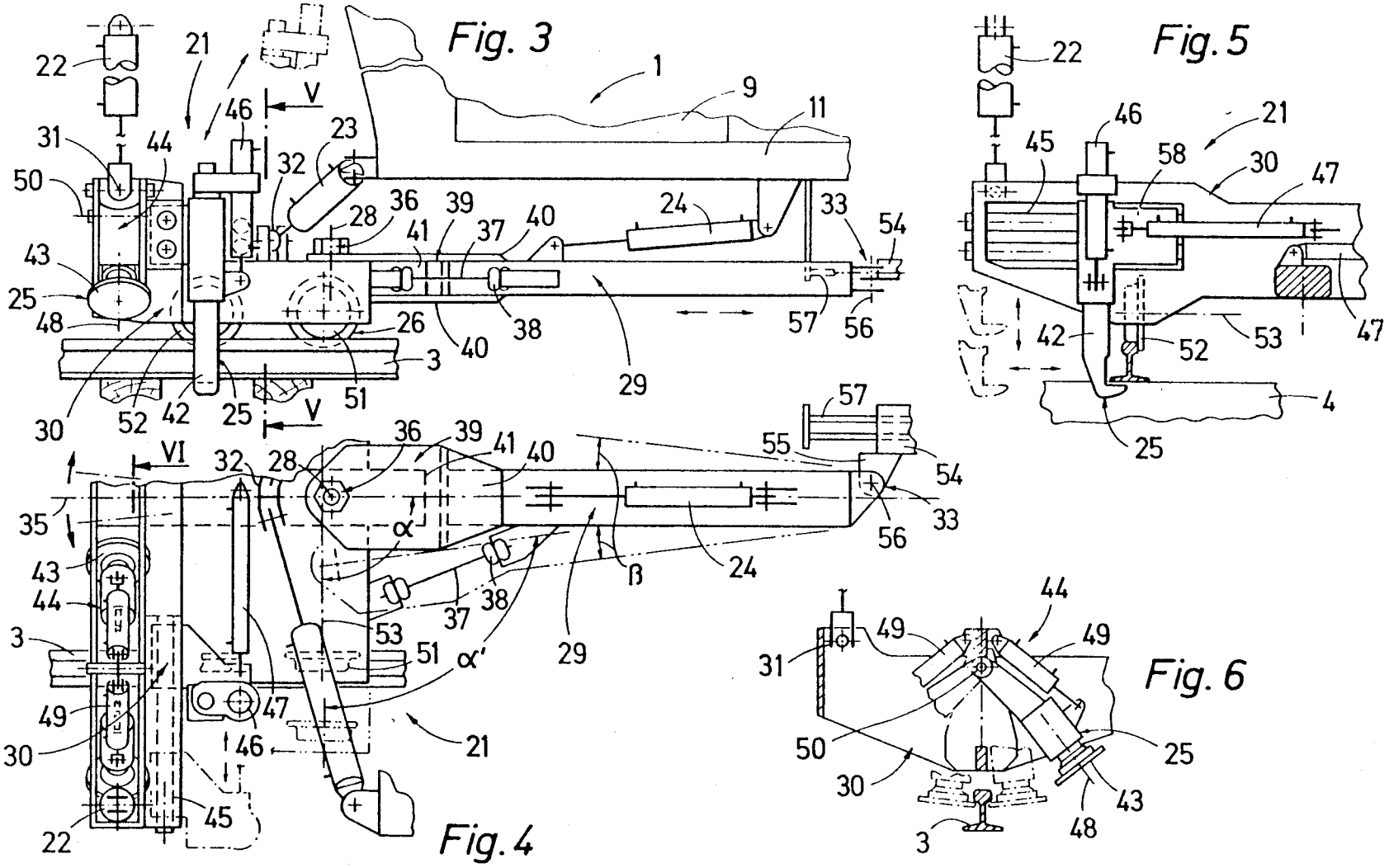
FIG. 3 is an enlarged, fragmentary side elevational view of one embodiment of the track lifting and lining unit.
FIG. 4 is a top view of the track lifting and lining unit of FIG. 3.
FIG. 5 is a fragmentary cross section along line V-V of FIG. 3.
FIG. 6 is a fragmentary cross section along line VI of FIG. 4, showing a pair of flanged lifting wheels.

FIGS. 1 and 2 show a mobile machine for correcting the position of track 5 and for tamping the track, which includes two rails 3 fastened to ties 4 defining cribs therebetween, the machine comprising elongated machine frame 11 mounted on the track and supported by two widely spaced undercarriages 2, 2 for moving in an operating direction indicated by arrow 19 to constitute compact track leveling, lining and tamping machine 1. The machine is moved along the track by drive 6 and an operator's cab 9 equipped with central control panel 8 as well as central power plant 10 are mounted on machine frame 11 between driver's cabs 7 arranged at the front and rear end of the machine frame. Track leveling and lining reference system 12 comprises tensioned reference wires and sensing rollers running on track rails 3 to sense any error in the track position. The machine further comprises a respective ballast tamping assembly 15 associated with each rail 3 and mounted on machine frame 11. Each ballast tamping assembly includes pairs of vibratory and reciprocatory tamping tools 13 operated by hydraulic drives and mounted on tool carrier 16, hydraulic drive 14 being arranged to raise and lower the tamping tools out of, and into, the ballast adjacent the longitudinal sides of the ties. Tamping tool carrier 16 is pivotally mounted on machine frame 11 for pivoting about vertical axis 17 in a horizontal plane so that the tamping tool jaws may be positioned parallel to the longitudinal sides of any obliquely positioned tie 4. Each ballast tamping assembly 15 is transversely displaceably mounted on guide beams 18 extending perpendicularly to the direction of elongation of the machine frame and may be independently displaced therealong by hydraulic drives connected thereto. Machine 1 is a standard railroad car movable along track 5, and trailer 20 carrying a ballast broom is coupled to its rear end.

Track lifting and lining unit 21 for correcting the position of track 5 is mounted on machine frame 11 adjacent ballast tamping assemblies 15 and preceding the same in the operating direction. According to the invention, the track lifting and lining unit comprises two-part tool carrier frame 27 extending in the direction of elongation of machine frame 11 and having the advantageous design of a carrier frame with a central, forwardly projecting pole. First tool carrier frame part 30 is arranged adjacent ballast tamping assemblies 15 and rearwardly of second tool carrier frame part 29 in the operating direction. Two pairs 51, 52 of flanged wheels 26 support tool carrier frame 27 on track rails 3 and the two pairs of flanged wheels are rotatable about respective axes 53 defining a plane. The pairs of flanged wheels are spaced from each other to form front pair 51 and rear pair 52 of flanged wheels on first tool carrier frame part 30 in the direction of elongation of machine frame 11 and serve as track lining tools 26. Two track lifting tools 25 are arranged on first tool carrier frame part 30 for adjustable engagement with each rail 3. Pivot 36 links first and second tool carrier frame parts 30, 29 for pivoting about axis 28 extending substantially perpendicularly to the plane defined by the axes of the flanged wheels. Lifting and lining drives 22 and 23 have respective ends linked at pivots 31 and 32 to first tool carrier frame part 30 and to machine frame 11, and an end of second tool carrier frame part 29 remote from pivot 36 is linked at pivot 33 to the machine frame so that beam-shaped part 29, which is centered with respect to first tool carrier frame part 30 and projects therefrom in the direction of elongation of machine frame 11, always extends along center line 34 of track 5, as shown in FIG. 2. Pivot 33 is formed by shackle 55 affixed to guide block 54 displaceably glidable along guides 57 extending in the direction of elongation of machine frame 11 and fixedly mounted thereon. The shackle forms a connection between the first and second tool carrier frame parts and is pivotal about vertical axis 56, an additional slight pivoting motion being possible about a transverse axis extending perpendicularly to axis 56 so that raising during track position correction or in transit (see chain-dotted lines in FIG. 3) is possible.

Preferably, the rotating axes of pairs 51, 52 of flanged wheels are spaced apart about one crib width, i.e. about 50 cm, and beam-shaped second tool carrier frame part 30 has a length of about three and a half crib widths, i.e. about 2 m. Such a spacing of the lining tools makes it possible to orient the lining wheel axles substantially radially in an arcuate track curve when the rear tool carrier frame part is pivoted about vertical axis 28 and, in addition, this spacing of the points of engagement of the lining wheels with the rail will assure an advantageous distribution of the lining forces. The indicated length of the beam-shaped front part will enable a sufficient pivoting of the entire tool carrier frame even in sharp curves to enable the unit to function properly for leveling and lining such track curves.

Track leveling and lining reference system 12 operatively controls lifting and lining drives 22, 23. The longitudinal center line of the machine is indicated by reference numeral 35.

In the embodiment of FIGS. 3 to 6, longitudinally adjustable linking arrangement 37 connects first and second tool carrier frame parts 30, 29 in addition to pivot 36 for supporting the pivoting of the tool carrier frame parts about axis 28. Illustrated linking arrangement 37 comprises shock-absorbing hollow rubber spring elements 38 for varying the length of the linking arrangement. Pivot 36 links the front end of first tool carrier frame part 30 to the rear end of second tool carrier frame part 29. The adjustable linking arrangement will enable the two tool carrier frame parts to be re-aligned rapidly and automatically in tangent track and in track curves after each lining operation. This will stabilize the tool carrier frame, particularly during operation in tangent track when the axes of the pairs of flanged lining wheels extend substantially perpendicularly to the beam-shaped second tool carrier frame part. Any mutual movement of the two tool carrier frame parts in relation to each other is effectively avoided by the shock-absorbing rubber elements since the transverse lining movement is not effected by the compression of the hollow shock absorbers while the pivoted rear tool carrier frame part is rapidly restored to its original position. The arrangement of pivot 36 at the respective ends of the two tool carrier frame parts provides an advantageous design for coupling the two parts without interfering with the mounting of the lifting and lining tools on the rear tool carrier frame part.

Front tool carrier frame part 29 comprises at the rear end thereof two spaced sliding plates 40, 40 extending substantially parallel to the plane defined by the flanged lining wheel axes 53 and perpendicularly to pivoting axis 28, thereby forming fork 39 straddling pivot 36, and rear tool carrier frame part 30 has forwardly projecting end piece 41 extending beyond the pivoting axis between the two sliding plates. This sliding fork link efficiently and in a trouble-free manner transmits the lifting forces applied to the track from the rear tool carrier frame part to the front tool carrier frame part while, at the same time, relieving pivot 36 and without interfering with the pivoting motion of the two tool carrier frame parts about axis 28.

As shown in FIGS. 3 to 6, track lifting tools 25 comprise, per rail, a lifting hook 42 and respective drives 46, 47 for vertically and transversely adjusting the lifting hook, and pair 44 of tong-like cooperating lifting rollers 43 and respective independently operable drive 49, 49 for pivoting each lifting roller into and out of clamping engagement with rail 3, FIG. 6 showing the clamping engagement in chain-dotted lines while the disengaged position of the lifting rollers is illustrated in full lines in this figure. Each lifting hook 42 is mounted for transverse displacement on transverse guides 45. Each lifting roller 43 is freely rotatable about axis 48 and pivotal by independent drive 49 about axis 50 extending in the direction of elongation of rail 3. This track lifting arrangement has been found to be very effective and can be readily installed on first tool carrier frame part 30 without interfering with the pivoting thereof so that the machine is useful for lifting even the heaviest track sections accurately and in a trouble-free manner. If any of the lifting tools encounter an obstacle, it may be adjusted into an inoperative position.

As shown in FIG. 5, lifting hooks 42 are arranged in transverse alignment with rear pair 52 of the flanged lining wheels and the pairs of tong-like cooperating lining rollers 43 are arranged rearwardly of lifting hooks 42, in the operating direction. Thus, the lifting hooks at the field sides of rails 3 face the lining rollers at the gage side of the rails. Vertical adjustment of lifting hooks 42 in guide block 58 by drives 46 enables the lifting hooks to be engaged selectively with the foot or the head of the rail. Each lifting hook is connected to the piston rods of cylinder-piston drives 46, 47. To enable the lifting hooks to be positioned between the ties along the rail foot, unit 21 may be longitudinally displaced by drive 24.

The operation of track lifting and lining unit 21 will now be described in detail in connection with FIGS. 1 to 6.

When track leveling, lining and tamping machine 1 has reached the operating site, unit 21 is lowered onto track 5 by vertical adjustment drives 22 from its raised transit position schematically indicated in chain-dotted lines in FIG. 3 to its operating position wherein pairs 51, 52 of the flanged lining wheels engage track rails 3. In their normal position in transit and tangent track, first and second tool carrier frame parts 30, 29 are in straight alignment, i.e. rotating axes 53 of the flanged wheels enclose a substantially right angle $\alpha$ with longitudinal axis 35 of the machine. During a leveling operation, lifting hooks 42 are adjusted for selective engagement with the foot or head of track rails 3 by operating drives 46, 47. If the lifting hooks in engagement with the foot of the rails encounter a tie or any other obstacles preventing proper engagement, drive 24 is operated to displace the track lifting and lining unit along the track until the proper engagement of the lifting hooks with the track rails is possible. This longitudinal displacement will cause pivot 33 to be similarly displaced along guides 57 affixed to machine frame 11. At the same time, tong-like pairs 44 of lifting rollers 43 are engaged with the rail heads. Lifting and lining drives 22, 23 are then operated to level and line track 5 until a control signal emitted by leveling and lining reference system 12 indicates the desired track position, at which point operation of the lifting and lining drives is discontinued in response to the control signal. The transverse lining force is distributed to both flanged wheels at a respective rail, automatically causing first tool carrier frame part 30 to be pivoted about axis 28 until the two flanged wheels are flush with the respective rail and are pressed thereagainst.

As shown in FIG. 2, longitudinal axis 35 of machine frame 11 forms a chord in an arcuate track curve having, for example, a radius of 80 m. Since the two flanged wheels pressed against the rail force rear tool carrier frame part 30 to follow the track curve, this tool carrier frame part will be pivoted about axis 28 and second tool carrier frame part 29 will be pivoted about axis 56 at pivot 33. This pivoting of the two tool carrier frame parts about axis 28 enables the two lining tools 26 to press evenly against the selected rail and to distribute the lining force equally over two spaced rail points, regardless of the pivoting angle and the radius of the arcuate track curve. The pivoting of rear tool carrier frame part 30 causes the hollow resilient rubber elements 38 to be compressed and when the operating pressure on hydraulic lining drive 23 is discontinued at the end of the lining operation, the resilient rubber elements will automatically return the rear tool carrier frame part to its original position and, in tangent track, into straight alignment with front tool carrier frame part 29. FIG. 4 illustrates the relative position of the two tool carrier frame parts 29, 30 in a curve which bends in a direction opposite to that shown in FIG. 2, i.e. mirror-symmetrically thereto. In this position, the angle $\alpha'$ is larger than angle $\alpha$ by the pivoting angle of rear tool carrier frame part 30 about axis 28. Front tool carrier frame part 29 may be laterally pivoted about axis 56 by angle $\beta$ which may be as large as 7°.

FIGS. 7 and 8 show another embodiment of a track lifting and lining unit according to the invention, unit 59 being mounted on machine frame 62 of track leveling, lining and tamping machine 64 of the same general type as illustrated in FIG. 1 for correcting the position of a track including two rails 60 fastened to ties 61, the front end of track lifting and lining unit 59 being linked to the machine frame at pivot 62. As in the first-described embodiment, unit 59 comprises two-part tool carrier frame 68, first tool carrier part 67 being arranged adjacent a ballast tamping assembly (not shown) and rearwardly of second tool carrier frame part 66 in the operating direction of the machine, indicated by arrow 81. Pivot 69 is a universal pivot linking the first and second tool carrier frame parts for pivoting not only about vertical axis 65 but in all directions. Universal pivot 69 is arranged centrally at a rear end of tool carrier frame 68 adjacent the ballast tamping assembly and second tool carrier frame part 67 is beam-shaped and extends to the rear tool carrier frame end. Such a universal linkage assures an even greater movability of rear tool carrier frame part 67 and accordingly produces an improved two-point lining arrangement. This further enhances the quality of the track position correction operation and the track correction force is always evenly distributed over two successive rail points and the stress on the rail fastening elements is considerably reduced. The extension of the beam-shaped front tool carrier frame part over the entire length of the tool carrier frame enables a relatively large pivoting movement to be effected in track curves.

Two pairs 71, 72 of flanged wheels support tool carrier frame 68 on track rails 60 and are spaced from each other to form front pair 71 and rear pair 72 of flanged wheels on first tool carrier frame part 67 in the direction of elongation of machine frame 63 and serve as track lining tools 70. Track lifting tools 73 are also arranged on first tool carrier frame part 67 for adjustable engagement with each rail and comprise, per rail, transversely adjustable lifting roller 75 arranged between rotating axes 90, 91 of pairs 71 and 72 of the flanged wheels and a drive for transversely adjusting the lifting roller into and out of engagement with rail 60, as well as a pair 74 of tong-like cooperating lifting rollers and a respective independently operable drive for pivoting each lifting roller into and out of clamping engagement with the rail. The lifting tools further comprise a lifting hook 73 for engagement with each rail, similar to lifting hook 42. First tool carrier frame part 67, on which the track lifting and lining tools are mounted, is arranged above a rear section of second, beam-shaped tool carrier frame part 66 and pivot 69 so that the first tool carrier frame part is supported on the beam-shaped tool carrier frame part while being pivotal universally about pivot 69. The arrangement of the additional lifting roller between the two lining tools holds the flanges of the lining tools securely in engagement with the selected rail head during the track position correction and assures an efficient and accurate two-point lining and lifting operation.

As in the first-described embodiment, lifting and lining drives 77, 78 have respective ends 79, 80 linked to first tool carrier frame part 67 and machine frame 63. Securing device 83 on first tool carrier frame part 67 is displaceable beyond a front end thereof for affixing one end of cylinder-piston drive 82 thereto and an opposite end of drive 82 is connected to second, beam-shaped tool carrier frame part 66, which has a length of about 3.5 m. Nose-shaped abutment 84 is arranged above drive 82. This arrangement makes it possible to restrict the universal movement of rear tool carrier frame part 67 to pivoting about a vertical and a transverse axis. In this way, an uncontrolled rise of the rear tool carrier frame part can be avoided when, for example, the front track lifting tools cannot be engaged with the rails because of the presence of a fish plate or the like. The simple nose-shaped abutment will prevent an upward pivoting so that the tool carrier frame will be securely held in place during transit.

As clearly shown in the drawing, second, beam-shaped tool carrier frame part 66 projects centrally from first tool carrier frame part 67 and unit 59 further comprises linking arrangement 85 connecting the first and second tool carrier frame parts in addition to pivot 69 for supporting the pivoting of the tool carrier frame parts. The linking arrangement comprises links (see FIG. 8) extending substantially parallel to the second, beam-shaped tool carrier frame part at respective sides thereof to form a mirror-symmetrical linkage. The links are longitudinally adjustable by hollow shock-absorbing rubber elements 86 and are constituted by connecting rods whose front ends are connected to transverse yoke 88 pivotally connected to second, beam-shaped tool carrier frame part 66 and displaceable thereon in the direction of elongation of machine frame 63 by drive 87 for displacing the yoke in this direction. The transverse yoke is displaceably mounted on two parallel guides 89 affixed to the machine frame. This linkage arranged at both sides of the beam-shaped tool carrier part effectively and resiliently limits the pivoting movement while rapidly restoring and stabilizing the position of the first tool carrier frame part after each track position correction operation. Linkage to the longitudinally displaceable transverse yoke enables the entire tool carrier frame 68 to be longitudinally repositioned so that the lifting tools may be engaged with the rails in case they encounter an obstacle and without interfering with the stabilizing effect of the linking arrangement.

As appears from FIGS. 7 and 8, rotating axes 90, 91 of flanged lining wheels 70 extend substantially perpendicularly to longitudinal axis 92 of beam-shaped tool carrier frame part 66 in tangent track. This basic position of tool carrier frame 68 is stabilized by linking arrangement 85 which limits the movement of the tool carrier frame parts relative to each other. In this basic operating position, bolt-shaped securing device 83 is displaced beyond the front end of first tool carrier frame part 67 by cylinder-piston drive 82. This will limit the pivoting movement of first tool carrier frame part 67 about universal pivot 69 in a vertical direction (see chain-double dotted line in FIG. 7) during a track lifting operation when an obstacle at the track prevents front lifting rollers 75 and lifting hook 76 from engaging the rail or in a curve superelevation. Nose-shaped abutment 84 serves to extend this abutment range during transit of the machine, at which time securing bolt 83 is not displaced forwardly beyond the first tool carrier frame part. The described pivoting movement about pivot 69 in a plane extending perpendicularly to the plane of the track (see arcuate arrows in FIG. 7) enables rear pair 74 of lifting rollers as well as front lifting roller 75 to be in full engagement with the rail head in all intermediate lifting positions. This evenly distributes the lifting forces over longitudinally spaced points along the rail. At the same time, the first tool carrier frame part is pivoted about universal pivot 69 in a plane extending parallel to that of the track (see arcuate arrows and chain-double dotted lines in FIG. 8). The lateral pivoting of first tool carrier frame part 67 about a vertical axis of pivot 62 is forced by the engagement of flanged lining wheels 70 with the selected rail. This pivoting angle $\gamma$ may be up to 7°. This pivoting movement will compress elastic shock-absorbing elements 66 of linking arrangement 85. When lining forces are transmitted to the selected rail by drives 78, rear tool carrier frame part 67 will be additionally pivoted about pivot 69 in a horizontal plane until the flanges of both lining tools 70 are pressed evenly against selected rail 60.

What is claimed is:

1. A mobile machine for correcting the position of a track and for tamping ballast, the track including two rails fastened to ties defining cribs therebetween, the machine comprising (a) an elongated machine frame mounted on the track for moving in an operating direction, (b) a ballast tamping assembly mounted on the machine frame and including tamping tools arranged to tamp ballast under respective ones of the ties, (c) a track lifting and lining unit for correcting the position of the track, the unit being mounted on the machine frame adjacent the ballast tamping assembly and preceding the ballast tamping assembly in the operation direction, and the track lifting and lining unit comprising (1) a two-part carrier frame extending in the direction of elongation of the machine frame, a first tool carrier frame part being arranged adjacent the ballast tamping assembly and rearwardly of a second tool carrier frame part in the operating direction, (2) two pairs of flanged wheels supporting the tool carrier frame on the track rails, the two pairs of flanged wheels being rotatable about respective horizontal axes defining a plane and being spaced from each other to form a front pair and a rear pair of flanged wheels on the first tool carrier frame part in the direction of elongation of the machine frame and serving as track lining tools, (3) at least two track lifting tools arranged on the first tool carrier frame part for adjustable engagement with each rail, (4) a pivot linking the first and second tool carrier frame parts for pivoting about an axis extending substantially perpendicularly to the plane defined by the axes of the flanged wheels, and (5) a longitudinal adjustable linking arrangement connecting the first and second tool carrier frame parts in addition to the pivot for controlling the pivoting movement of the tool carrier frame parts about the pivot, (d) lifting and lining drives having respective ends linked to the first tool carrier frame part and to the machine frame, and (e) an end of the second tool carrier frame part remote from the pivot being linked to the machine frame.

2. The mobile machine of claim 1, further comprising a track leveling and lining reference system operatively controlling the lifting and lining drives, and two widely spaced undercarriages supporting the machine frame, the ballast tamping assembly and the track lifting and lining units being arranged between the undercarriages to constitute a compact track leveling, lining and tamping machine.

3. The mobile machine of claim 1, wherein the linking arrangement comprises shock-absorbing rubber spring elements.

4. The mobile machine of claim 1, wherein the pivot links a front end of the first tool carrier frame part to a rear end of the second tool carrier frame part.

5. The mobile machine of claim 4, wherein the second tool carrier frame part is beam-shaped and is centered with respect to the first tool carrier frame part, extending therefrom in the direction of elongation of the machine frame.

6. The mobile machine of claim 5, wherein the rotating axes of the pairs of flanged wheels are spaced apart about one crib width and the beam-shaped second tool carrier frame part has a length of about three and a half crib widths.

7. The mobile machine of claim 5, wherein the second tool carrier frame part comprises two spaced sliding plates extending substantially parallel to the plane and perpendicularly to the pivoting axis, thereby forming a fork straddling the pivot, and the first tool carrier frame part has a forwardly projecting end piece extending beyond the pivoting axis between the two sliding plates.

8. The mobile machine of claim 1, wherein the track lifting tools comprise, per rail, a lifting hook and respective drives for vertically and transversely adjusting the lifting hook, and a pair of tong-like cooperating lifting rollers and a respective independently operable drive for pivoting each lifting roller into and out of clamping engagement with the rail.

9. The mobile machine of claim 8, wherein the lifting hooks are arranged in transverse alignment with the rear pair of flanged wheels and the pairs of tong-like cooperating lifting rollers are arranged rearwardly of the lifting hooks, in the operating direction.

10. The mobile machine of claim 1, wherein the pivot is a universal pivot arranged centrally at a rear end of the tool carrier frame adjacent the ballast tamping assembly for pivoting the tool carrier frame parts in all directions, and the second tool carrier frame part is beam-shaped and extends to the rear end.

11. The mobile machine of claim 10, wherein the first tool carrier frame part is arranged above a rear section of the second, beam-shaped tool carrier frame part.

12. The mobile machine of claim 10, further comprising a cylinder-piston drive having opposite ends, a securing device displaceable beyond a front end of the first tool carrier frame part for affixing one of the drive ends to the first tool carrier frame part, the opposite drive end being connected to the second, beam-shaped tool carrier frame part, and an abutment arranged above the drive.

13. The mobile machine of claim 10, wherein the track lifting tools comprise, per rail, a transversely adjustable lifting roller arranged between the rotating axes of the pairs of flanged wheels and a drive for transversely adjusting the lifting roller into and out of engagement with the rail.

14. The mobile machine of claim 13, wherein the track lifting tools further comprise, per rail, a pair of tong-like cooperating lifting rollers and a respective independently operable drive for pivoting each lifting roller into and out of clamping engagement with the rail.

15. The mobile machine of claim 10, wherein the second, beam-shaped tool carrier frame part projects centrally from the first tool carrier frame part, and the linking arrangement comprising links extending substantially parallel to the second, beam-shaped tool carrier frame part at respective sides thereof.

16. The mobile machine of claim 15, wherein the links are longitudinally adjustable and comprise shock-absorbing rubber elements, further comprising a transverse yoke pivotally connected to the second, beam-shaped tool carrier frame part and displaceable thereon in the direction of elongation of the machine frame, the links being connected to the yoke, and a drive for displacing the transverse yoke in said direction.

* * * * *